US007484281B2

(12) United States Patent
Klann

(10) Patent No.: US 7,484,281 B2
(45) Date of Patent: Feb. 3, 2009

(54) TOOL SYSTEM FOR REPLACING A GLOW PLUG OF A DIESEL ENGINE

(75) Inventor: Horst Klann, Villingen-Schwenningen (DE)

(73) Assignee: Klann Spezial-Werkzeugbau GmbH, Donaueschingen (DE)

( * ) Notice: Subject to any disclaimer, the term of this patent is extended or adjusted under 35 U.S.C. 154(b) by 366 days.

(21) Appl. No.: 11/419,615

(22) Filed: May 22, 2006

(65) Prior Publication Data

US 2006/0260110 A1 Nov. 23, 2006

(30) Foreign Application Priority Data

May 23, 2005 (DE) ..... 20 2005 008 241 U

(51) Int. Cl.
*B21D 39/04* (2006.01)

(52) U.S. Cl. ..... 29/33 R; 29/282

(58) Field of Classification Search ..... 29/33 R, 29/426.4, 402.17; 81/53.2; 123/193.5; 408/115 R, 408/72 B, 115 B, 241 B
See application file for complete search history.

(56) References Cited

U.S. PATENT DOCUMENTS 2,547,986 A * 4/1951 Van Dermark et al. ..... 29/426.4
3,694,838 A * 10/1972 Runton ..... 470/199
4,682,395 A * 7/1987 Klann ..... 29/261
4,870,740 A * 10/1989 Klann ..... 29/263
5,649,791 A * 7/1997 Connolly ..... 408/1 R
5,820,314 A * 10/1998 Dunbar ..... 408/72 B
5,888,034 A * 3/1999 Greenberg ..... 408/115 R
6,070,762 A * 6/2000 Klann ..... 222/83.5
6,668,784 B1 * 12/2003 Sellers et al. ..... 123/193.5
2005/0066776 A1 * 3/2005 Ward et al. ..... 81/53.2
2005/0278917 A1 * 12/2005 Klann ..... 29/214

FOREIGN PATENT DOCUMENTS

DE 4431952 A1 * 3/1996

* cited by examiner

*Primary Examiner*—Dana Ross
(74) *Attorney, Agent, or Firm*—McGlew and Tuttle, P.C.

(57) ABSTRACT

A tool system for replacing a glow plug (31) of a diesel engine includes a plurality of tools (55), by means of which a defective glow plug (31), which is screwed tightly into an internal thread (33) of a mounting hole (32) of a cylinder head (30) of the diesel engine, can be removed from the mounting hole (32), the glow plug (31) being arranged in a radially expanded, cylindrical depression (34) of the mounting hole (32) of the cylinder head (30). To make it possible to accurately align the individual tools (55) necessary for replacing the glow plug (31) with the central longitudinal axis of the mounting hole (32), a clamping sleeve (2) is provided, which can be inserted into the depression (34) and into which a centering sleeve (1, 20) can be pushed to concentrically align the individual tools (55, 65, 75, 85, 95). The clamping sleeve (2) can be pressed into the depression (34) to hold the centering sleeve (1, 20) in a fixed and clamping manner.

12 Claims, 10 Drawing Sheets

Fig. 5 - prior art

Fig. 6 - prior art

TOOL SYSTEM FOR REPLACING A GLOW PLUG OF A DIESEL ENGINE

CROSS REFERENCE TO RELATED APPLICATIONS

This application claims the benefit of priority under 35 U.S.C. § 119 of German Patent Application DE 20 2005 008 241.4 filed May 23, 2005, the entire contents of which are incorporated herein by reference.

FIELD OF THE INVENTION

The present invention pertains to a tool system for replacing a glow plug of a diesel engine, comprising a plurality of tools, by means of which a defective glow plug, which is screwed tightly into an internal thread of a mounting hole of a cylinder head of the diesel engine, can be removed from the mounting hole, the glow plug being arranged in a radially expanded, cylindrical depression of the mounting hole of the cylinder head.

BACKGROUND OF THE INVENTION

To improve the cold start behavior of a diesel engine, so-called glow plugs are used in diesel engines. These glow plugs are screwed tightly into a mounting hole of a cylinder head of the diesel engine. The glow plugs pass through the cylinder head into the respective corresponding combustion chamber, so that the latter can be preheated by the glow plug when needed before the diesel engine is started. In the area of the combustion chamber-side end the glow plugs have a heating element, which protrudes at least minimally into the combustion chamber of the corresponding cylinder of the diesel engine.

This heating element is accommodated by a mounting tube, which is provided with a mounting screw in its end area located opposite the heating element. The mounting hole of the cylinder head correspondingly also has a corresponding internal thread in its axially outer end area, and the mounting tube with its mounting thread can be screwed into this internal thread. The mounting hole has a radially tapered section, by which a sealing seat is formed, toward the combustion chamber. The mounting tube of the glow plug is adapted to this offset design of the mounting hole and has a circular sealing surface, with which the mounting tube comes tightly into contact with the sealing seat of the mounting hole when it is screwed in, in a corresponding axial arrangement.

To screw in the glow plug, the mounting tube is provided with a hexagon insert bit made in one piece axially outside the mounting thread, so that the glow plug can be screwed into the mounting hole or the internal thread of the mounting hole by means of a conventional socket wrench.

After a longer operating time of the diesel engine, it is frequently necessary to replace defective glow plugs. It can frequently be observed in this connection that the mounting tube with its mounting thread is seated extremely tightly in the internal thread of the mounting hole, so that the hexagon insert bit is shorn off and the mounting tube with its mounting thread thus remains in the internal thread during the attempt to screw the mounting tube and thus the entire glow plug out of the mounting hole via the hexagon insert bit.

A contact pin, which has a contact element on the outside, is inserted into the mounting tube for the electric connection. After the hexagon insert bit has been shorn off, it is now necessary to remove first this contact pin together with the contact element in order to make it possible to remove the hexagon insert bit from the rest of the mounting tube. A conventional socket nut, which is attached to the contact element by pressing or hammering, is normally used for this purpose, and this contact element now assumes the contour of the socket nut. The socket nut may be designed as an inner Torx or hexagon socket. By subsequently rotating the socket nut by means of a suitable tool, the contact element is now shorn off together with the contact pin, so that these can be removed from the mounting tube. The mounting tube is thus accessible now from the outside.

To remove the mounting tube and thus the rest of the glow plug with the heating element thereof from the mounting hole, the mounting tube is now drilled out with a so-called core hole drill as a next step, as a result of which the mounting thread of the mounting tube is removed, possibly without damaging the internal thread of the mounting hole. An internal thread can subsequently be tapped in the rest of the mounting tube by means of a conventional screw tap and pulled out by means of a draw spindle or the like. The internal thread of the cylinder head is subsequently to be finished by means of a corresponding screw tap in order to make it possible to insert a new glow plug.

Furthermore, provisions may be made for removing combustion residues or other contaminants, for example, oxidation products, from the mounting hole by means of a reamer before the new glow plug is inserted, so that the mounting hole will again assume, at least approximately, its original new state.

Both when the mounting thread is drilled out and when the internal thread of the cylinder head is retapped, it is necessary to align the corresponding tool coaxially with the central longitudinal axis of the mounting hole with the highest precision in order to ensure that a new glow plug will be screwed in absolutely satisfactorily centrally in relation to the hole in the cylinder head. This can be achieved with the conventional tools or tool systems with difficulty only.

SUMMARY OF THE INVENTION

Correspondingly, the object of the present invention is to design a tool system such that it is possible to accurately align the individual tools necessary for replacing the glow plug, such as core hole drills, screw taps or reamers, with the central longitudinal axis of the mounting hole.

The object is accomplished according to the present invention by a clamping sleeve, which can be inserted into the depression and into which a centering sleeve can be pushed for the concentric alignment of the individual tools, being provided, and by the clamping sleeve being able to be pressed into the depression for holding the centering sleeve in a fixed and clamping manner.

The embodiment according to the present invention makes available a tool system, by means of which the individual tools, especially tools necessary for replacing a defective glow plug, such as core hole drills, screw taps or reamers, can be aligned extremely precisely with the central longitudinal axis of the mounting hole for the glow plug.

The clamping sleeve is inserted for this purpose first into a cylindrical depression of the mounting hole of the cylinder head. Such cylindrical depressions are provided, as a rule, as radial expansions of the mounting hole in the axially outer area of the cylinder head. The centering sleeve is subsequently pushed fittingly into the clamping sleeve until the centering sleeve is in contact with the bottom of the radially expanded depression of the mounting hole.

In this position, the centering sleeve is already aligned coaxially or concentrically with the central longitudinal axis of the mounting hole via the clamping sleeve. By pressing the clamping sleeve into the depression, the aligned concentric position of the centering sleeve is fixed in the cylindrical depression of the mounting hole. The correspondingly necessary tool, for example, the core hole drill, can subsequently be pushed fittingly into the centering sleeve and, for example, the mounting thread of the mounting tube of the glow plug can be drilled.

After drilling out the mounting thread, an internal thread is to be tapped by means of a conventional screw tap in the mounting tube of the glow plug remaining in the mounting hole, so that this mounting tube can be pulled out of the mounting hole by means of a draw spindle. After pulling out the mounting tube, a screw tap can now be inserted into the centering sleeve to retap the internal thread of the mounting hole. The screw tap has a corresponding guide shaft in this case as well, via which it is guided in the centering sleeve with the smallest clearance, so that coaxial finishing of the internal thread of the mounting hole is ensured.

The other tools that may possibly be necessary for finishing the mounting hole, for example, a reamer, to remove combustion residues from the mounting hole, can also be inserted into the centering sleeve.

It is thus ensured according to the present invention that the tools, such as the core hole drill, the screw tap or the reamer, can be aligned absolutely concentrically with the central longitudinal axis of the mounting hole via the centering sleeve. Furthermore, it is ensured that a glow plug to be inserted anew can be inserted again into the mounting hole absolutely concentrically.

The above-described order of the operations is not compulsory. Thus, the mounting tube of the glow plug may also still remain in the mounting hole during the retapping of the internal thread. This has, for example, the advantage that chips that may be formed are caught by the mounting tube and thus they cannot enter the corresponding combustion chamber of the diesel engine.

Provisions may be made for the clamping sleeve to have a conical outer jacket surface, with which the clamping sleeve can be inserted into the depression, and for the clamping sleeve to have a cylindrical through hole, which is arranged concentrically with the jacket surface of the said clamping sleeve and whose diameter decreases when being pressed into the depression of the mounting hole for being held in a clamping manner and for aligning the centering sleeve concentrically with the mounting hole. On the one hand, secure concentric alignment of the centering sleeve as well as extremely tight holding of the centering sleeve in the clamping sleeve and in turn of the clamping sleeve in the depression of the cylinder head is achieved due to this embodiment, so that extremely reliable operation is made possible.

Concentric coaxial alignment of the centering sleeve together with the clamping sleeve in the depression of the mounting hole of the cylinder head is also achieved due another embodiment. Provisions are made for the conical jacket surface of the clamping sleeve to form a cone angle $\alpha$ of 1° to 10°. In particular, coaxial alignment of the clamping sleeve during the pressing into the depression is achieved because of this extremely small cone angle. A cone angle of 2° may be preferably provided here, so that the clamping sleeve is aligned coaxially when pressed into the depression of the mounting hole.

Furthermore, provisions may be made for the clamping sleeve to have, in its end area projecting from the depression, a radially projecting coupling web, with which the clamping sleeve can be caused to engage a striking tool in a positive-locking manner. Due to this embodiment, the clamping sleeve can be pressed into the depression and also can be pulled out of the said depression in a simple manner.

The striking tool may have a basic body with a striking weight movable on a sliding rod, i.e., the striking tool is designed as a kind of sledge hammer, which can be caused with its basic body to engage the coupling web of the clamping sleeve in a positive-locking manner. For this positive locking, the basic body has a U-shaped opening with a mounting groove, with which the basic body can be caused to engage the coupling web in a positive-locking manner. The clamping sleeve can thus be "driven" into the depression and also pulled out of same by the striking tool by means of the coupling web. Handling of the device according to the present invention is extremely simple due to this embodiment.

The present invention will be explained in greater detail below on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
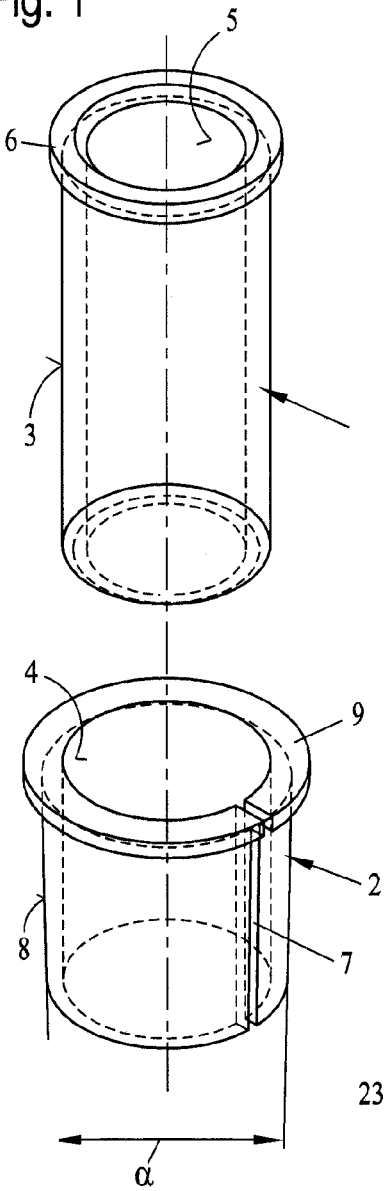
FIG. 1 is a perspective exploded view of a clamping sleeve together with a centering sleeve.

Referring to the drawings in particular, FIG. 1 shows a perspective exploded view of a centering sleeve 1 together with a clamping sleeve 2. The centering sleeve 1 has a cylindrical outer jacket surface 3, with which the centering sleeve 1 can be pushed into a cylindrical through hole 4 of the clamping sleeve 2. Furthermore, the centering sleeve 1 is provided with a cylindrical through hole 5, which is used to mount a tool. Furthermore, the centering sleeve 1 is radially expanded in the area of its upper end and is provided with a circular stop web 6, which acts as a stop when the clamping sleeve 2 is pulled out of a depression of a mounting hole for a glow plug.

Furthermore, it is visible from FIG. 1 that the clamping sleeve 2 is slotted and has a longitudinal slot 7 extending over the complete axial length thereof. It is achieved due to this longitudinal slot 7 that the clamping sleeve 2 can be compressed, so that the internal diameter of the through hole 4 decreases when the clamping sleeve is pressed into the above-mentioned depression. Clamping, tight holding of the centering sleeve 1 in the clamping sleeve 2 is achieved during use due to this embodiment.

Furthermore, FIG. 1 shows that the circular jacket surface 8 of the clamping sleeve 2 is of a conical design and has a cone angle $\alpha$ of about 1° to 10° and preferably 2°, as is shown in FIG. 1. A circular, radially outwardly projecting coupling web 9 is provided on the clamping sleeve 2 in the radially expanded, upper end area of this jacket surface 8. The clamping sleeve 2 can be caused to engage a striking tool in a positive-locking manner by means of this coupling web 9 for pressing into the depression and also for pulling out of this depression.

Figure 2:
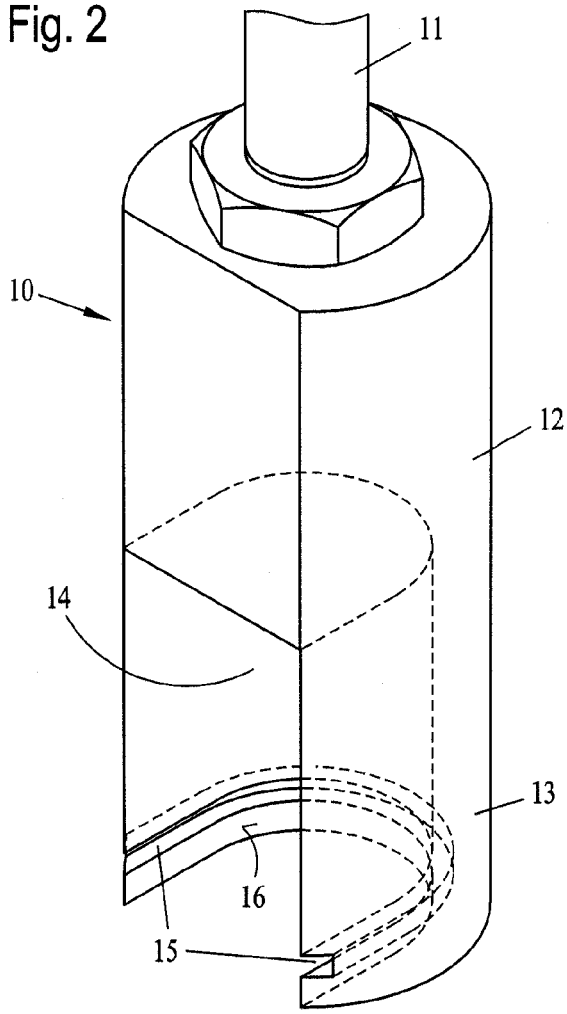
FIG. 2 is a perspective partial view of a basic body of a striking tool.

FIG. 2 shows for this a perspective view of a part of such a striking tool 10. This striking tool 10 has a sliding rod 11, whose function will be explained in greater detail in connection with FIG. 4. This sliding rod 11 is screwed into a basic body 12, which has a laterally and downwardly open U-shaped opening 14, which extends approximately over half of the axial length, in its lower end area 13 located opposite the sliding rod. This opening 14 forms a coupling section of the basic body 12, which has a U-shaped mounting groove 15 in its inner wall 16 in its lower end area. The clamping sleeve 2 with its coupling web 9 can be pushed fittingly into this mounting groove 15, so that the clamping sleeve 2 can be caused to engage the basic body 12 or the coupling section 14 thereof in an axially fixed, positive-locking manner. Thus, the clamping sleeve 2 can be pressed into a corresponding hole, on the one hand, and can also be pulled out of same, on the other hand, by means of the striking tool 10 via the basic body 12 of the said striking tool.

Figure 3:
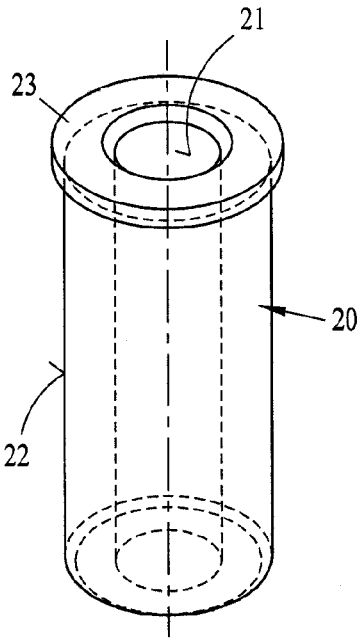
FIG. 3 is a second exemplary embodiment of a centering sleeve.

FIG. 3 shows a second exemplary embodiment of a centering sleeve 20, which differs from the centering sleeve 1 from FIG. 1 only by the smaller internal diameter of its cylindrical through hole 21. This centering sleeve 20 likewise has a cylindrical jacket surface 22, with which the centering sleeve 20 can be pushed fittingly into the cylindrical through hole 4 of the clamping sleeve 2. Furthermore, the centering sleeve 20 likewise has, in its upper end area, a radially projecting stop web 23, with which the clamping sleeve 2 is in contact during the pulling out of this clamping sleeve 2 from a hole, so that the centering sleeve 20 is also pulled out uniformly via its stop web 23. This centering sleeve 20 is used to guide a tool, whose diameter is made smaller than the diameter of such tools, which are to be used with the centering sleeve 1.

Figure 4:
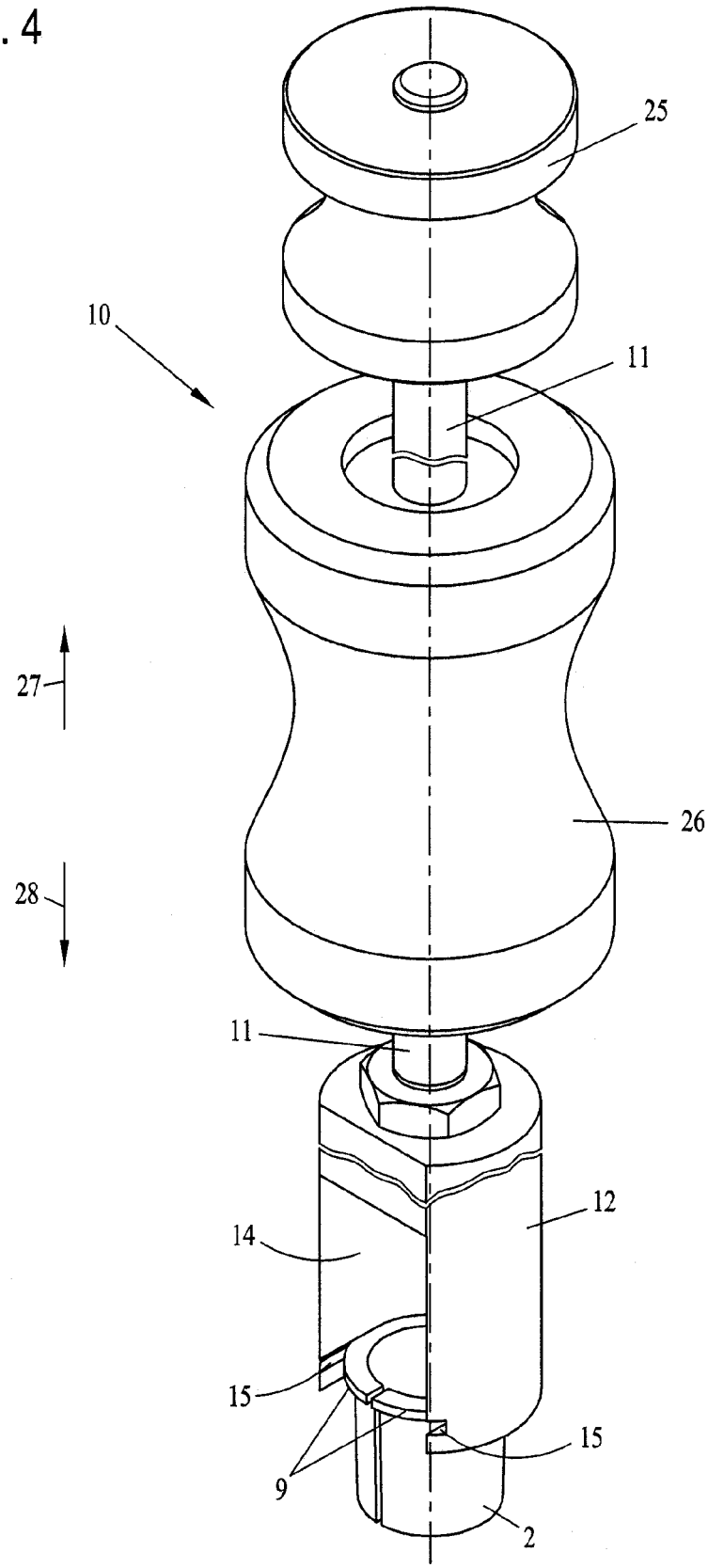
FIG. 4 is a perspective view of the complete striking tool with the basic body from FIG. 2 as well as the clamping sleeve from FIG. 1, which engages the basic body.

FIG. 4 shows a perspective view of the complete striking tool 10 with its sliding rod 11 as well as with its basic body 12. The sliding rod 11 and the basic body 12 are shown in an axially shortened form. It can be recognized that a grip part 25 is screwed on the upper part of the sliding rod 11. Furthermore, a striking weight 26, which can be displaced along the sliding rod 11, on the one hand, in the direction of arrow 27 in relation to the grip part 25 and, on the other hand, in the direction of arrow 28 downwardly in relation to the basic body 12, is provided on the sliding rod 11 between the said grip part 25 and the said basic body 12. It is easy to imagine that when the striking weight 26 strikes the grip part 25, pulling pulses act on the basic body 12 in the direction of arrow 27 via the sliding rod 11. Pressing-in forces or striking forces will correspondingly act on the basic body 12 due to the striking of the striking weight 26 in the direction of arrow 28.

Furthermore, it appears from FIG. 4 that the clamping sleeve 2 with its coupling web 9 engages the mounting groove 15 of the basic body 12 or the coupling section 14 thereof in an axially fixed and positive-locking manner. It can be recognized from FIG. 4 that pulse-like striking forces can be applied to the clamping sleeve 2 inserted by means of the striking tool 10 via the basic body 12 of said striking tool both in the direction of arrow 27 and in direction of arrow 28. Thus, both pressing-in forces and pressing-out forces can be applied by means of the striking tool 10 because of the positive-locking connection of the clamping sleeve 2 via the coupling web 9 of the said clamping sleeve 2 with the basic body 12 via the mounting groove 15 of the said basic body 12, so that the clamping sleeve 2 can be pressed into a hole and also be pulled out of same in a simple manner. Furthermore, the clamping sleeve 2 is received in the mounting groove 15 in a such a way that it extends coaxially with the sliding rod 11, so that the striking pulses are also introduced concentrically into the clamping sleeve. The clamping sleeve can thus be driven absolutely coaxially into a corresponding hole or cylindrical depression.

Figure 5:
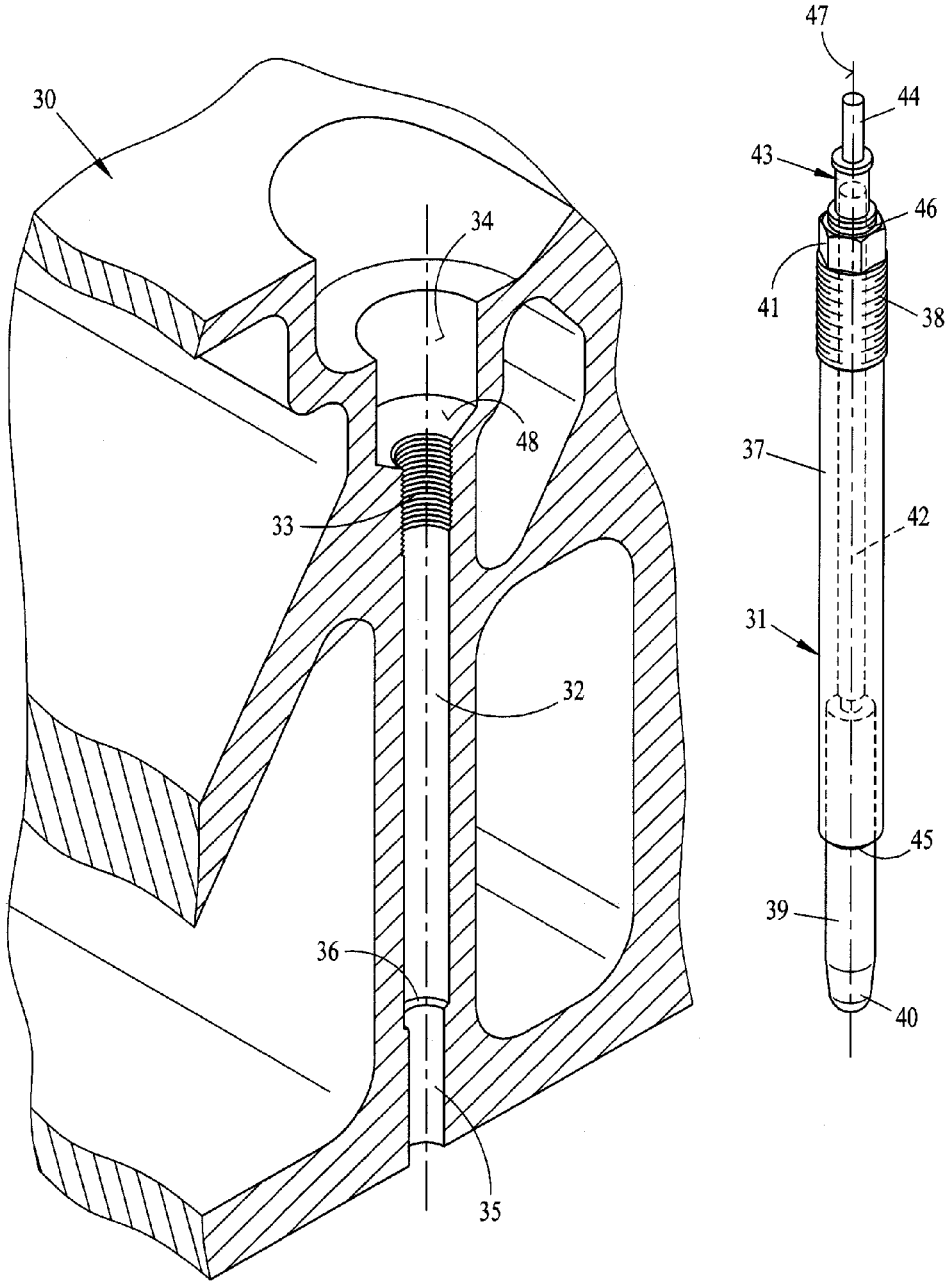
FIG. 5 is a partial section of a cylinder head with a mounting hole for a glow plug together with a perspective view of a view of a glow plug.

FIG. 5 shows a vertical partial section of a cylinder head 30 together with a glow plug 31 in a perspective exploded view. It can be recognized that the cylinder head 30 has a mounting hole 32, which is provided with an internal thread 33 in its upper end area. Above this internal thread 33, the mounting hole 32 is provided with a radially expanded depression 34. The mounting hole 32 is stepped in its lower end area and has a radially tapered mounting channel 35. The mounting hole thus forms a ring-shaped sealing seat 36 in the upper end area of this mounting channel 35.

During operation, the glow plug 31 is fittingly inserted into the mounting hole 32. The glow plug 31 has for this purpose a cylindrical mounting tube 37, in the upper end area of which a mounting thread 38 is provided. A heating element 39, which protrudes with its downwardly conically tapering end 40 at least partially into the combustion chamber of a diesel engine or the cylinder of a diesel engine during operation, projects from the mounting tube 37 in an axially downwardly projecting manner.

A hexagon insert bit 41 is made in one piece with the mounting tube 37 above the mounting thread 38 of the mounting tube 37. The mounting tube 37 is used to receive a contact pin 42, which is indicated by broken lines in FIG. 5. This contact pin 42 connects the heating element 39 with a contact element 43, which is insulated against the mounting tube 37.

The contact element 43 is in connection with the contact pin 42 via a pressed connection. As is also apparent from FIG. 5, this contact element 43 has an axially upwardly projecting connection pin 44, to which a corresponding contact plug can be plugged.

It is easy to imagine that the glow plug 31 with its heating element 39 and with the mounting tube 37 can be screwed via its mounting thread 38 into the internal thread 33 of the mounting hole 32. The hexagon insert bit 41 is used to tightly tighten the glow plug 31 in the mounting hole 32. Furthermore, it is seen in FIG. 5 that the diameter of the heating element 39 is smaller than that of the mounting tube 37, so that a circular sealing surface 45 is formed between the heating element 39 and the mounting tube 37. This sealing surface 45 is pressed against the circular sealing seat 36 of the mounting hole 32 in the mounted state, so that the glow plug 31 can be inserted in a sealed manner into the mounting hole 32.

The diameters of the mounting tube 37 as well as of the heating element 39 may be slightly smaller than the corresponding sections of the mounting hole 32 and the mounting channel 35. The consequence of this is that combustion residues may be deposited especially in the area of the mounting channel 35 in the annular space formed between the heating element 39 and the mounting channel 35. This in turn leads to the extremely tight holding of the entire glow plug 31 in the mounting hole 32.

The consequence of this is, in turn, that the glow plug 31 cannot be simply screwed out of the mounting hole 32 for replacement. It can frequently be observed in this connection that the hexagon insert bit 41 is shorn off above the mounting thread 38 at the mounting tube 37, so that complete removal of the glow plug 31 is not possible. It shall also be mentioned here that the contact element 43 is pressed into the mounting tube 37 by means of a pressed connection via sealing elements 46, which are electrically insulating, in the area of the hexagon insert bit 41. Since the glow plug 31 cannot be screwed out of the mounting hole 32 any longer now after the hexagon insert bit 41 has been shorn off, special measures are necessary.

FIG. 6 shows for this once again a vertical partial section of the glow plug 31 inserted into the cylinder head 30 or the mounting hole 32 of the cylinder head. The general inner structure of the glow plug 31 can be essentially recognized from FIG. 6. The heating element 39 is plugged into the mounting tube 37 and is held there, for example, by means of a soldered or pressed connection. It can also be seen that in this state in which it is screwed into the mounting hole 32, the glow plug 31 is seated with its sealing surface 45 on the sealing seat 36 of the mounting hole 32. The contact pin 42, which is plugged into the heating element 39 within the mounting tube 37 in an electrically contacting manner, is arranged within the mounting tube 37. A pressed connection or the like may be provided here as well. With its upper end area, the contact pin 42 projects over the mounting tube 37, above the upper hexagon insert bit 41 of the mounting tube, so that the contact element 43 can be plugged to this upper end of the contact pin and can be fixed to this via a pressed connection.

Figure 6:
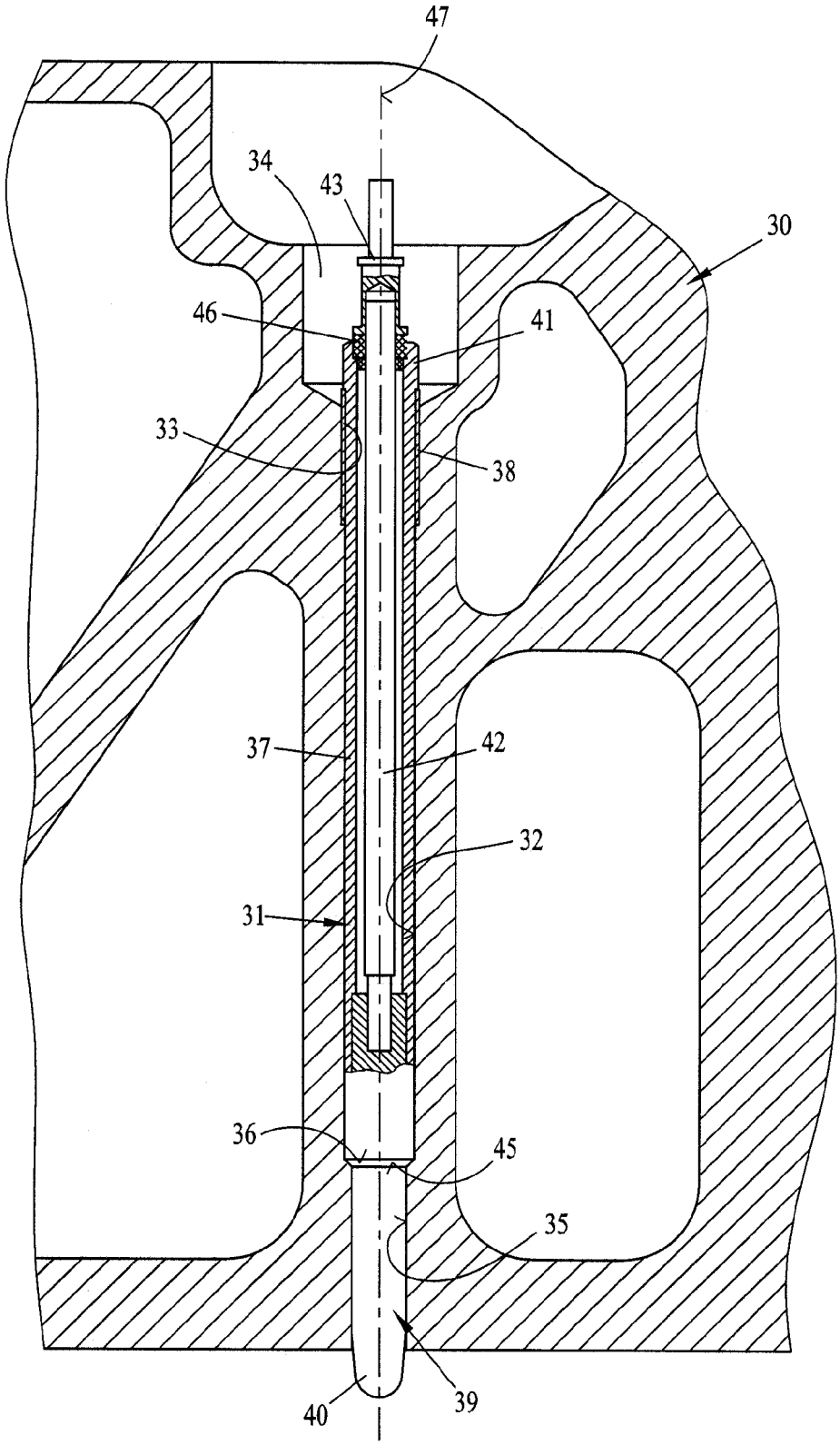
FIG. 6 is a vertical section through the cylinder head in the area of the mounting hole with the glow plug inserted.

Furthermore, it is seen from FIG. 6 that this contact element 43 is pressed into the mounting tube 37 via the seals 46 in the area of the hexagon insert bit 41. The mounting tube 37 itself is in turn seated with its mounting thread 38 in the internal thread 33 of the mounting hole 32, and the mounting thread 38 axially projects from the internal thread 33. It is ensured as a result that the glow plug with its conical sealing surface 45, which is ring-shaped in this exemplary embodiment, can be brought sealingly into contact with the sealing seat 36. Furthermore, it is seen from FIG. 6 that the lower end 40 of the heating element 39 projects from the cylinder head 30 in this mounted state. The combustion chamber of the diesel engine or of a cylinder of the diesel engine is known to be located in this lower end area.

Only an extremely small radial gap is provided between the mounting tube 37 and the mounting hole 32 as well as the heating element 39 and the mounting channel 35, so that an annular space each is formed here. Such an annular space must be provided in order to prevent excessive heat transfer from the glow plug to the cylinder head when the glow plug is activated and thus to guarantee the desired heating function of the glow plug in the combustion chamber. In other words, the glow plug is usually in contact with the cylinder head by the mounting thread 38 and the sealing surface 45 only. Based on these tight dimensions, these annular spaces cannot be recognized in FIG. 6. However, it is easy to imagine that combustion residues can accumulate in the annular spaces between the mounting tube 37 and the mounting hole 32, on the one hand, and the mounting channel 35 and the heating element 39, on the other hand. As a result, the glow plug 31 sort of "burns together" with its mounting tube 37 in the mounting hole 32 or with its heating element 39 in the mounting channel 35 after a longer operating time the heating element 39 in the mounting channel 35, so that the glow plug 31 is seated extremely tightly in the cylinder head 30. As was explained above, this causes, when an attempt is made at screwing the glow plug 31 out of the mounting hole 32 by means of the hexagon insert bit 41, that the hexagon insert bit 41 will be shorn off above the mounting thread 38 and that it is no longer possible to screw out the glow plug 31 further.

To make it possible to remove the glow plug 31, a socket nut with a small diameter is first attached by hammering the contact element 43, so that the wrench profile of the socket nut is transmitted to the contact element. By rotating the contact element, the contact pin 42 is now shorn off and can be removed. The hexagon insert bit 41 is subsequently removed unless it has already been removed together with the contact element 43 during the removal of the contact pin 42. The mounting tube 37 is now freely accessible from the top.

Furthermore, it can also be recognized from FIG. 6 that the glow plug 31 is arranged, especially with its hexagon insert bit 41, recessed in the radially expanded depression 34 of the mounting hole 32. This depression 34 is arranged concentrically with the central longitudinal axis 47 of the mounting hole 32 and has a cylindrical design.

To make it now possible to remove the "remnants" of the glow plug 31, it is at first necessary to drill out the mounting tube 37 in the area of the mounting thread 38 to the core diameter of this thread 38 or of the associated internal thread 33 of the mounting hole 32. It is necessary now to align the corresponding core hole drill as concentrically and coaxially with the central longitudinal axis 47 of the mounting hole 32 as possible in order not to damage the internal thread 33 during drilling out.

The centering sleeve 1 and the clamping sleeve 2 shown in FIG. 1 are provided for this.

Figure 7:
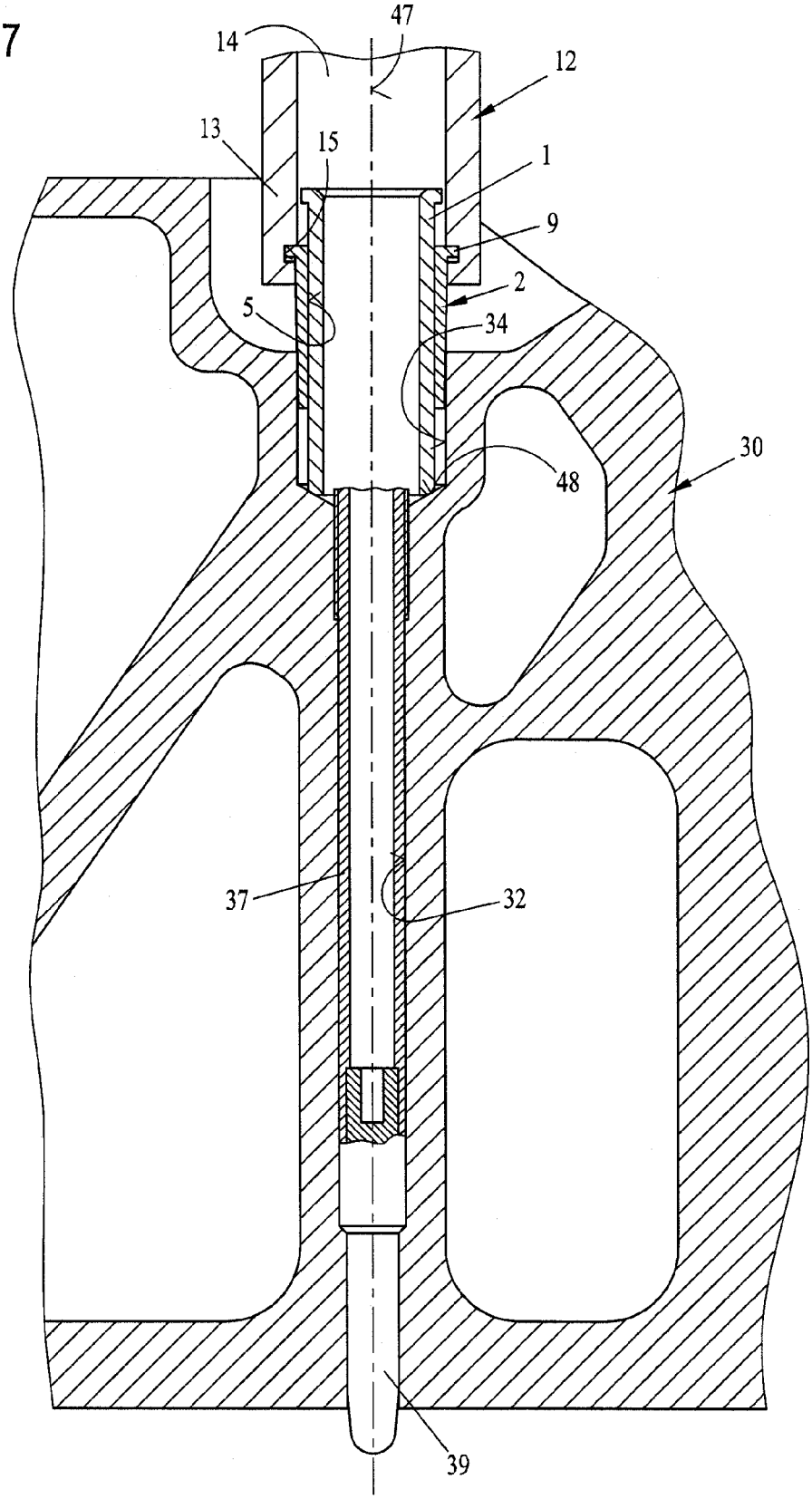
FIG. 7 is the section from FIG. 6 with a mounting tube, a glow plug as well as with the centering sleeve and the clamping sleeve in its state in which it is inserted into the radially expanded depression of the mounting hole.

FIG. 7 shows for this the centering sleeve 1 and the clamping sleeve 2 during use. The contact pin 42 has already been removed together with the contact element 43 in FIG. 7. The hexagon insert bit 41 shorn off is also already removed in FIG. 7. It can be recognized that the clamping sleeve 2 is inserted into the upper, radially expanded depression 34 of the mounting hole 32. The centering sleeve 1 is pushed into the clamping sleeve 2 and is fittingly in contact with the bottom 48 of the depression 34 by its lower end edge, extending concentrically with the central longitudinal axis 47 of the mounting hole 32.

Due to the extremely small cone angle α of jacket surface 8 (FIG. 1) of the clamping sleeve 2, equaling 3°, maximum, and preferably 2°, the clamping sleeve 2 is also aligned coaxially and concentrically with the central longitudinal axis 47 of the mounting hole 42 in the attached state shown in FIG. 7.

After the centering sleeve 1 and the clamping sleeve 2 have been inserted into the depression 34 in the manner shown in FIG. 7, the striking tool 10 is now caused to engage by the mounting groove 15 of its basic body 12 or by its opening 14 the radially projecting coupling web 9 of the clamping sleeve 2. FIG. 7 shows only the lower end area 13 of the basic body 12. After the basic body 12 has been attached to the clamping sleeve 2, the striking weight 26 is moved, as can best be recognized from FIG. 4, in the direction of arrow 28 along the sliding rod 11 against the basic body 12, so that the clamping sleeve 2 is pressed into the depression 34. After the extremely small path of adjustment of a few mm, it is achieved at the same time because of the conical shape of the jacket surface 8 of the clamping sleeve 2 that the centering sleeve 1 is held in a clamping manner in the through hole 5 of the clamping sleeve 2. A corresponding processing tool can now be inserted, extending concentrically and coaxially with the central longitudinal axis 47 of the mounting hole 32, into the centering sleeve 1 in this tight state of the centering sleeve 1 as well as of the clamping sleeve 2.

FIGS. 8 through 12 show various tools for this, which can be used, depending on the application, to remove the mounting tube 37 together with the heating element 39.

Figure 8:
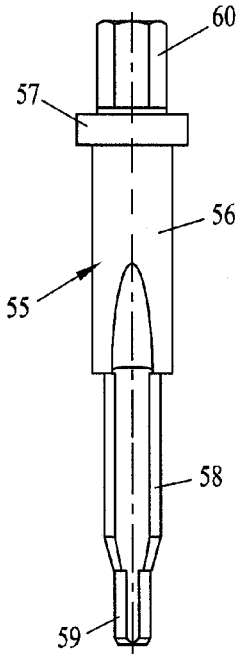
FIG. 8 is an exemplary embodiment of a core hole drill, which is used to drill out a mounting thread of the mounting tube of the glow plug.

FIG. 8 shows as an example a so-called core hole drill 55, which is provided to drill out the mounting thread 38 of the mounting tube 37. To push in this core hole drill 55 in an accurately fitting manner and to guide this core hole drill in an accurately fitting manner, the drill has a guide shaft 56, which is limited upwardly by a radially expanded, circular stop web 57. This stop web 57 is used as a means limiting the extent of pushing in and thus as a means limiting the maximum possible depth of drilling of the core hole drill 55.

The guide shaft 56 is joined downward by the drilling tool 58 proper, whose design is sufficiently known from the state of the art. The mounting tube 37 is drilled to the core diameter of the mounting thread 38 in the area of the mounting thread 38 of the mounting tube 37 by means of this drilling tool, so that the remaining thread segments located in the internal thread 33 of the mounting hole 32 will fall out of this internal thread 33 after the core hole drill 55 has been pulled out or can be cut out by retapping. To improve the guiding of the core hole drill 55, the latter additionally also has, in the axial extension downward toward the drilling tool 58, a centering pin 59, which can be pushed fittingly into the nondrilled mounting tube 37. As is apparent from FIG. 8, the core hole drill may be provided with a drive hexagon 60 above its stop web 57 to rotatingly drive the core hole drill. Instead of such a drive hexagon, 60, to which a corresponding tool can be attached, the core hole drill 55 may also be provided with a cylindrical drive shaft for use with a drill or the like.

Figure 9:
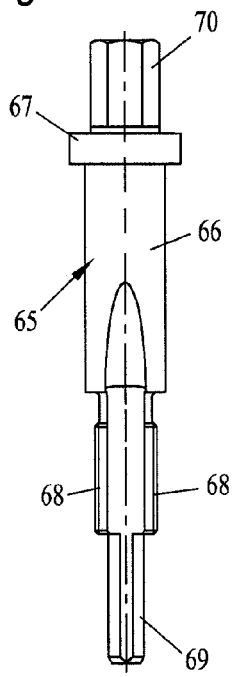
FIG. 9 is a screw tap, which is provided to retap the internal thread of the mounting hole.

FIG. 9 shows a second tool in the form of a screw tap 65. To guide this screw tap 65 accurately coaxially and concentrically in the centering sleeve, this screw tap also has a guide shaft 66, by means of which the screw tap 65 can be fittingly inserted into the through hole 5 of the centering sleeve 1.

The screw tap 65 also has, at the upper end of its guide shaft 66, a radially expanded stop web 67, which is likewise used as a means limiting the path of adjustment of the screw tap 65. Following the guide shaft 66, the screw tap is provided with a plurality of thread cutters, by means of which the internal thread 33 of the mounting hole 32 can be retapped. In the axial extension to its thread cutters 68, the screw tap 65 is also provided with a centering pin 69, via which the coaxial and concentric guiding of the entire screw tap 65 in relation to the mounting hole 32 is improved. Thus, this centering pin 69 engages the mounting tube 37, which is still seated in the mounting hole 32, with a small clearance during the retapping of the internal thread 33. It is advantageous now that all chips fall into the mounting tube 37 both during the drilling out of the mounting thread 38 and during the retapping of the internal thread 33, so that there is no risk that any chips could enter the combustion chamber of the diesel engine. The screw tap 65 is provided with a drive hexagon 70.

Figure 10:
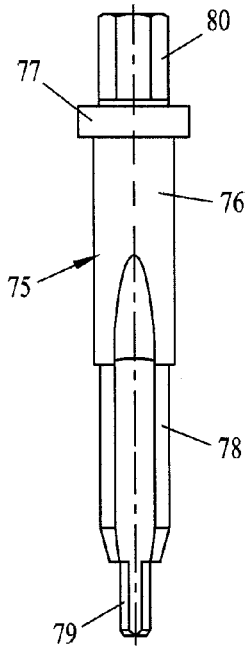
FIG. 10 is a second core hole drill, which is provided to redrill the internal thread of the mounting hole for inserting a threaded sleeve.

If the internal thread 33 of the mounting hole 32 is irreversibly damaged, the mounting hole 32 is usually to be drilled out in the axial area of the original internal thread 33 and to be provided with a larger thread, into which a threaded bush, which will then again be used to screw in a new glow plug, can then be inserted. FIG. 10 shows for this as an example a second core hole drill 75, which likewise has a guide shaft 76, a stop web 77 as well as a drilling tool 78 with an axially projecting centering pin 79. The core hole drill 75 is also provided with a corresponding drive hexagon 80 for rotating drive in this exemplary embodiment.

Figure 11:
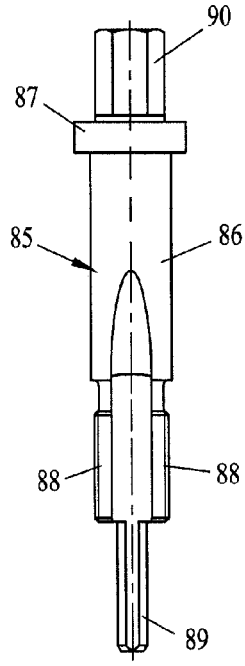
FIG. 11 is a second screw tap, by means of which a larger thread can be prepared in the redrilled section of the mounting hole.

A second screw tap 85 shown in FIG. 11 is provided in connection with this screw tap 65 having a larger diameter. This screw tap 85 also has a corresponding guide shaft 86 for coaxial and concentric guiding in the through hole 5 of the centering sleeve 1. The guide shaft 86 is limited on the top side by a radially projecting stop web 87, by which the depth of cutting is likewise limited during thread cutting. Various thread cutters 88, which are likewise provided, in turn, with a centering pin 89 in the axial extension, adjoin downward in the case of this screw tap 85 as well. The screw tap 85 also has a corresponding drive hexagon 90 for rotating drive.

All the tools shown in FIGS. 8 through 11 can be used with the mounting tube 37 still being inserted into the mounting hole 32. This has especially the advantage that all the chips generated are received by the mounting tube 37 during the drilling and tapping operations.

Figure 12:
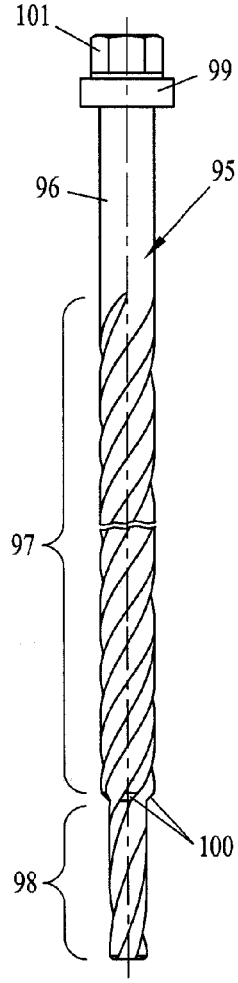
FIG. 12 is a reamer, by means of which the entire mounting hole can be finished.

The tool from FIG. 12 is to be used in connection with the second centering sleeve 20 from FIG. 3 in this exemplary embodiment and is shown in an axially shortened form in FIG. 12. The tool from FIG. 12 is a so-called reamer, which is used to finish the mounting hole 32 starting from the internal thread 33 toward the combustion chamber. Since combustion residues occur especially in the area of the mounting channel 35, these can be removed by means of the reamer 95. The reamer 95 has, in its upper end area, a guide shaft 96, which can be pushed fittingly through the through hole 21 of the centering sleeve 20 during use. The internal diameter also corresponds to the internal diameter of the mounting hole 32 that has not been drilled in this exemplary embodiment of this through hole 21, so that concentric alignment inevitably takes place here via the centering sleeve 20 as well as the mounting hole 32 itself.

As is apparent from FIG. 12, the reamer 95 has a middle cutter area 97, whose diameter corresponds to the guide shaft 96. Residues can be removed from the radially expanded section of the mounting hole 32 by means of this cutter area 97. Furthermore, the reamer 95 is provided, in the axial extension to this cutter area 97, with a radially tapered end section 98, which is likewise designed as a cutting tool. The diameter of this end section 98 corresponds to the desired or nominal diameter of the mounting channel 35, so that the mounting channel 35 of the mounting hole 32 can be freed from fuel residues through this end section 98. The reamer 95 also has, in the area of its upper end of the guide shaft 96, a radially expanded stop collar 99, by which the maximum depth of drilling is defined in cooperation with the axial length of the centering sleeve 20. Additional cutting elements 100, by which the sealing seat 36 of the mounting hole 32 can be finished, are provided here in the transition area between the lower end section 98 and the cutter area 97. This finishing takes place automatically at the end of the reaming operation, immediately before the reamer reaches its depth of drilling defined by the stop collar 99. Furthermore, the reamer 95 also has a drive hexagon 101 for being rotatingly driven at its upper end.

It is easy to imagine that extremely precise finishing of the mounting hole 32 with its mounting channel 35 as well as of the internal thread 33 can be carried out by means of the centering sleeves 1 and 20 as well as the clamping sleeve 2, in cooperation with the tools shown in FIGS. 8 through 12. Furthermore, the mounting thread can also be drilled out with precision by means of the core hole drill 55, so that damage to the internal thread 33 can be ruled out.

Figure 13:
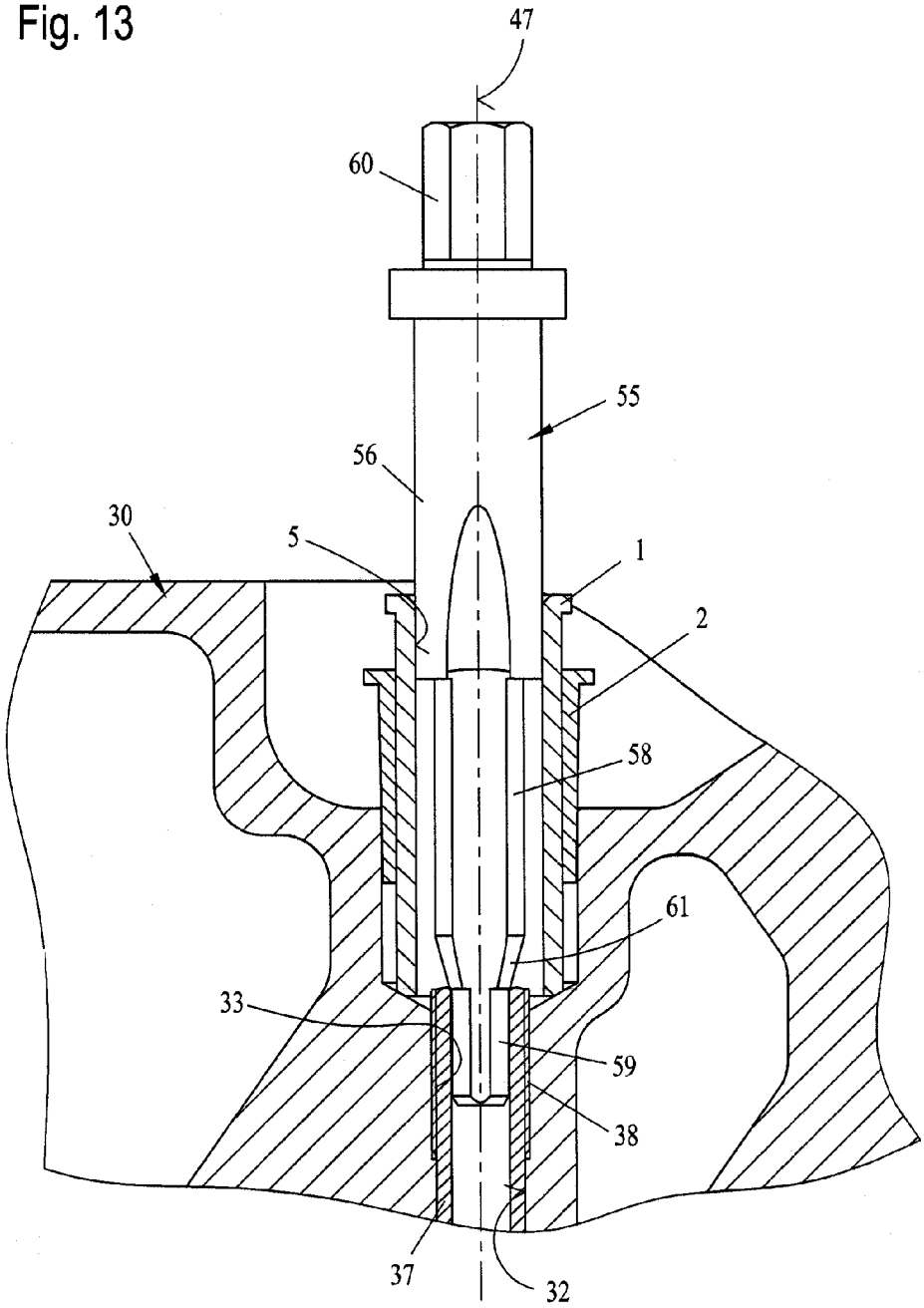
FIG. 13 is a partial section of the cylinder head with the core hole drill from FIG. 8 in its starting position in which it is inserted into the centering sleeve.

FIG. 13 shows for this as an example the use of the core hole drill 55 in cooperation with the centering sleeve 1 as well as with the clamping sleeve 2. It can be recognized that the core hole drill 55 with its guide shaft 56 is pushed fittingly into the through hole 5 of the centering sleeve 1. FIG. 13 shows the starting position of the core hole drill 55 immediately before the drilling operation. Furthermore, it can be recognized from FIG. 13 that the drilling tool 58 forms, toward the centering pin 59, a conical section 61, with which the core hole drill 55 is located directly in the upper end area of the mounting tube 37 in the starting position being shown. The centering pin 59 is additionally guided by the mounting tube 37 coaxially with the central longitudinal axis 47 of the mounting hole 32 in this exemplary embodiment. This embodiment with the centering pin 59 is not absolutely necessary, but it does improve the safe handling of the core hole drill 55. By subsequently rotating the core hole drill 55 by means of its drive hexagon 60, the core hole drill 55 is now drilled into the mounting tube 37, and the mounting tube 37 is drilled out in this drilling operation. The diameter of the core hole drill 55 and of the drilling tool 58 is dimensioned now such that the internal thread 33 of the mounting hole 32 is not damaged.

Figure 14:
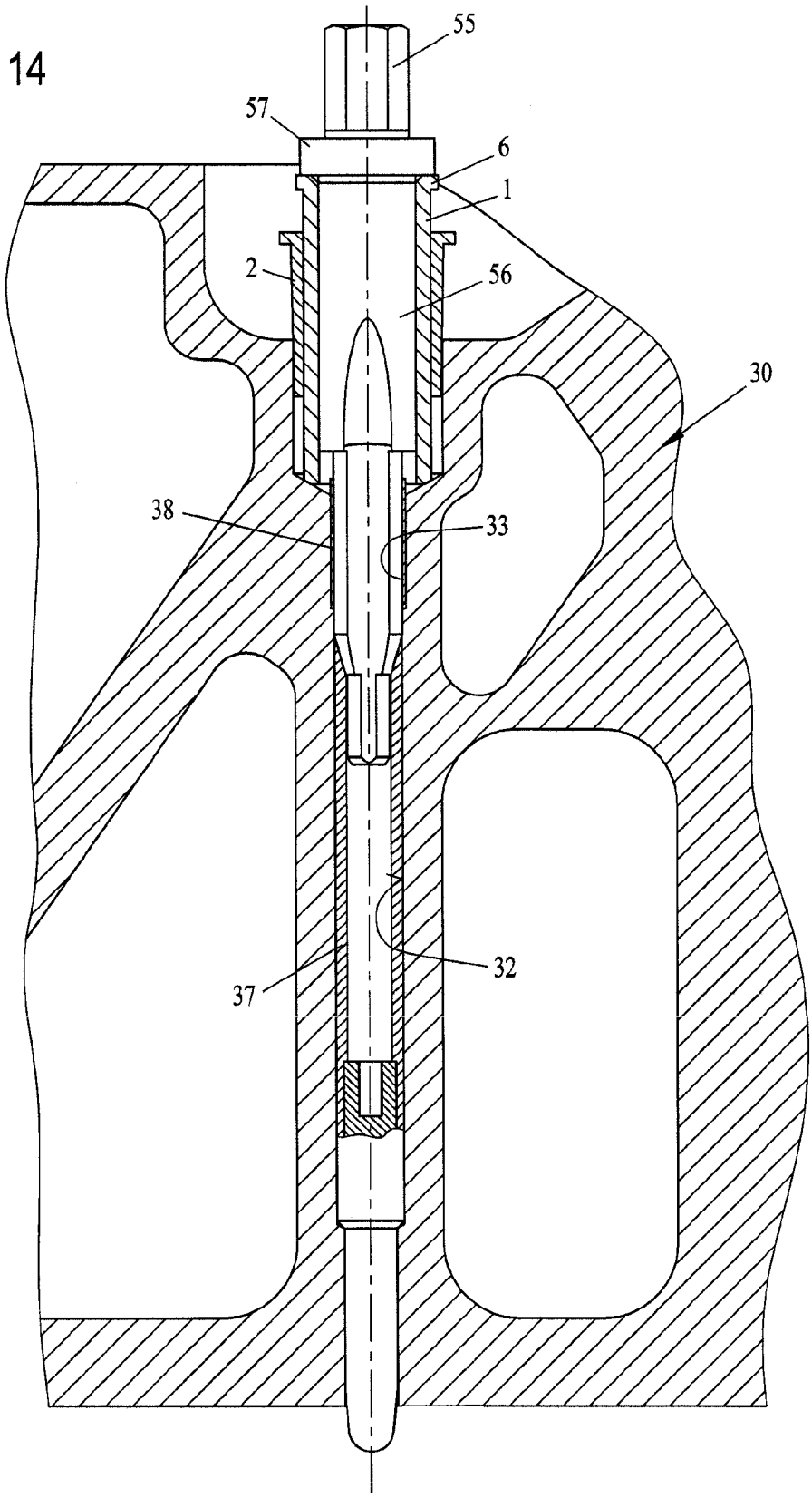
FIG. 14 is the view from FIG. 13 at the end of the drilling out of the mounting thread of the mounting tube.

FIG. 14 shows the end of the drilling operation, in which the core hole drill 55 with its stop web 57 is in contact on the top side with the radially projecting stop web 6 of the centering sleeve 1. The axial length of the drilling tool 58 as well as of the guide shaft 56 is dimensioned such that the mounting tube 37 is drilled out beyond the axial length of the internal thread 33. The thread turns of the mounting thread 38 remain at first in the thread turns of the internal thread 33 during this drilling operation. After removal of the core hole drill 55 from the centering sleeve 1, the residues of the mounting thread 38 can be removed from the internal thread 33 and these residues fall into the mounting tube 37 by themselves.

Figure 15:
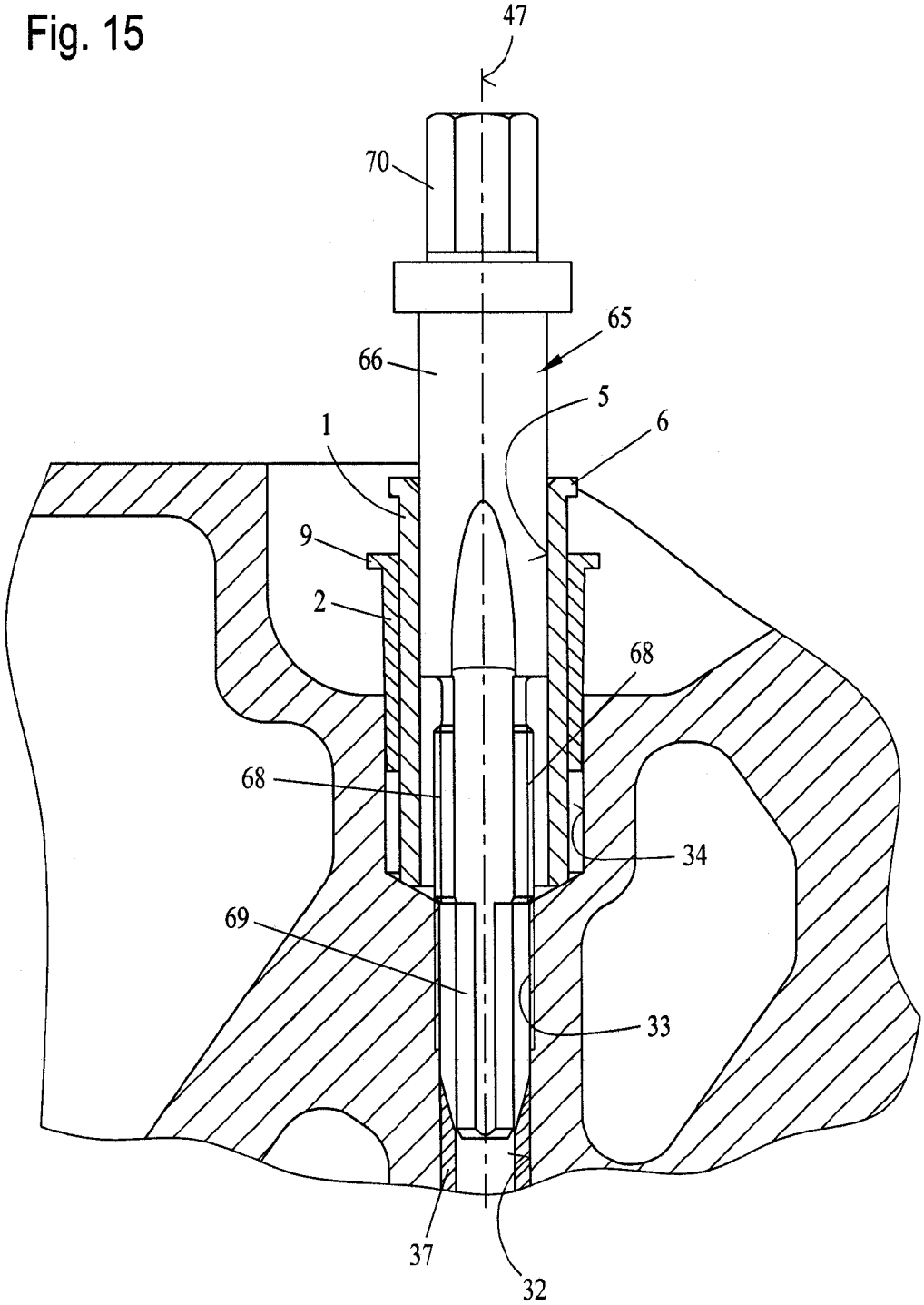
FIG. 15 is a partial section of the cylinder head with the core hole drill from FIG. 9 at the beginning of the retapping of the internal thread of the mounting hole of the cylinder head.

After drilling out the mounting tube 37, the screw tap 65 from FIG. 9 is used, as this is shown in FIG. 15. FIG. 15 shows the starting position of the screw tap 65 immediately before the beginning of the retapping of the internal thread 33 of the mounting hole 32. It can be recognized in this connection from FIG. 15 that the screw tap with its guide shaft 66 is also pushed fittingly into the through hole 5 of the centering sleeve 1. The thread cutters 68 are located directly at the upper end of the internal thread 33 of the mounting hole 32. At the same time, the length of the centering pin 68 is dimensioned such that this centering pin protrudes into the mounting tube 37, as this is visible in FIG. 15.

It is easy to imagine that when the screw tap 65 is actuated by rotation by means of its drive hexagon 70, the screw tap is screwed with its thread cutters 68 into the internal thread 33. Various residues, for example, thread turns of the mounting thread 38 still located in the thread turns of the internal thread 33, are removed in the process and the internal thread 33 is retapped.

It can also be recognized from FIG. 15 that the screw tap 65 is aligned concentrically with the central longitudinal axis 47 of the mounting hole 32 via the centering sleeve 1 as well as the clamping sleeve 2. It should be noted in this connection as well that the centering pin 69 is not absolutely necessary, but handling of the screw tap 65 is simplified. The length of the guide shaft 66 as well as the arrangement and the length of the thread cutters 68 are selected now such that the internal thread 33 is processed and retapped completely after the screw tap 65 has been screwed in completely.

After retapping the internal thread 33, the screw tap 65 can be removed again. The clamping sleeve 2 and the centering sleeve 1 are subsequently also removed from the depression 34 of the mounting hole 32. The striking tool 10 from FIG. 4 is again used for this. This is caused to engage the coupling web 9 of the clamping sleeve 2 via the mounting grove 15 and the striking weight 26 is then moved in the direction of arrow 27 (FIG. 4) against the grip part 25. Striking pulses are generated hereby in the direction of extraction indicated by arrow 27, so that the clamping sleeve 2 is pulled out of the depression 34. The clamping sleeve 2 with its coupling web 9 now strikes the stop web 6 of the centering sleeve 1, so that this is also pulled out at the same time and it cannot fall inadvertently down after the complete extraction of the clamping sleeve 2.

It can be recognized that a glow plug can be replaced in a very simple manner by means of the tool system of the type according to the present invention.

An internal thread, which is used to receive, for example, a draw spindle of a separate pulling device, is now cut as a next step into the mounting tube 37 remaining in the mounting hole 32 by means of a conventional screw tap (not shown in the drawing). The mounting tube 37 can then be pulled completely out of the mounting hole 32 together with the heating element 39 by means of this pulling device. Since such pulling devices are generally known from the state of the art, a detailed description will not be given here.

Figure 16:
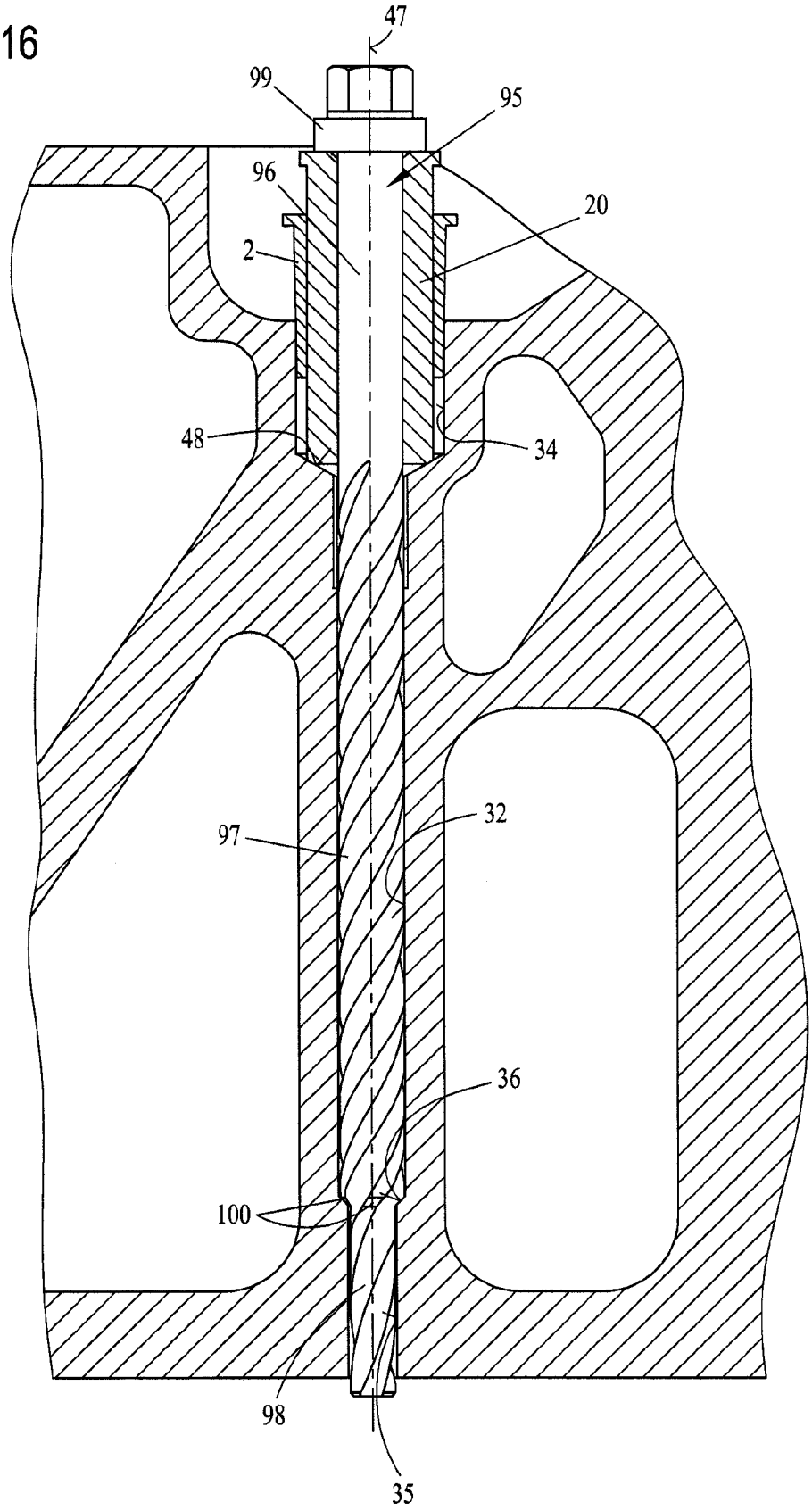
FIG. 16 is a partial section of the cylinder head with the reamer from FIG. 12 after "reaming" the mounting hole of the cylinder head.

The reamer 95 from FIG. 12 is used as the next step. As it is seen from FIG. 16, the second centering sleeve 20 from FIG. 3 is first inserted into the depression 34 together with the clamping sleeve 2 from FIG. 1. The clamping sleeve 2 is first introduced into the depression 34 and the centering sleeve 20 is then pushed into the clamping sleeve 2 to the bottom 48 of the depression 34. By subsequently pressing in the clamping sleeve 2 by means of the striking tool 10 from FIG. 4, concentric and coaxial alignment of the centering sleeve 20 with the central longitudinal axis 47 of the mounting hole 32 is achieved as well. The reamer 95 is used to "ream out" both the mounting hole 32 and the mounting channel 35 as well as the sealing seat 36. The length of the guide shaft 96 as well as the length of the cutting area 97, of the cutting elements 100 as well as of the end section 98 is selected to be such that the mounting hole 32, the sealing seat 36 as well as the mounting channel 35 will again have their original shapes corresponding to the new state after the processing. The lengths of the individual sections of the reamer 95 as well as the arrangement of the stop collar 99 are selected for this purpose such that such a restoration of the new state is guaranteed with certainty. FIG. 16 shows the end position of the reamer at the end of processing.

After the mounting hole 32, the sealing seat 36 as well as the mounting channel 35 have also been finished now, a new glow plug can be screwed into the mounting hole 32 or into the internal thread 33 of the said glow plug.

It also appears from FIG. 16 that the reamer 95 can be pushed fittingly with both its cutter area 97 and with its guide shaft 96 into the through hole 21 of the centering sleeve 20. Absolutely concentric and coaxial alignment of the reamer 95 with the central longitudinal axis 47 of the mounting hole 32 is achieved due to this embodiment already at the beginning of the operation.

In summary, it can be determined that glow plugs seated tightly in a cylinder head can be replaced simply and reliably by means of the embodiment according to the present invention, especially of the centering sleeve 1 and the clamping sleeve 2.

Furthermore, finishing and removal of a glow plug are also possible when the cylinder head is mounted and the diesel engine is installed in the vehicle, if this is permitted by the space conditions in the engine compartment and the arrangement of the glow plug in the cylinder head.

While specific embodiments of the invention have been shown and described in detail to illustrate the application of the principles of the invention, it will be understood that the invention may be embodied otherwise without departing from such principles.

What is claimed is:

1. A tool system for replacing a glow plug of a diesel engine, the tool system comprising:

a plurality of tools by means of which a defective glow plug of a cylinder head, which glow plug is screwed tightly into an internal thread of a mounting hole of the cylinder head of the diesel engine, can be removed from the mounting hole, the glow plug being arranged in a, radially expanded, cylindrical depression of the mounting hole of the cylinder head, a clamping sleeve to be inserted into the depression, said clamping sleeve having a conical outer jacket surface, with which said clamping sleeve can be inserted into the depression; and a centering sleeve to be pushed into the clamping sleeve for a concentric alignment of the individual tools wherein said clamping sleeve is pressable into the depression for holding the centering sleeve in a fixed and clamping manner, wherein said clamping sleeve has a cylindrical through hole, which is arranged concentrically with said jacket surface and has a diameter that decreases when being pressed into the depression of the mounting hole for holding in a clamping manner and for concentric alignment of said centering sleeve with the mounting hole.

2. A tool system in accordance with claim 1, wherein the conical jacket surface of the clamping sleeve forms a cone angle $\alpha$ of 0.5° to 10°.

3. A tool system in accordance with claim 1, wherein in an end area projecting from the depression, said clamping sleeve has a radially projecting coupling web, with which said clamping sleeve can be caused to engage a striking tool in a positive-locking manner.

4. A tool system in accordance with claim 3, wherein:

said striking tool has a basic body with a striking weight movable on a sliding rod; and said basic body has a U-shaped opening, which is open laterally and on one side axially, said basic body having an inner wall of said U-shaped opening provided with a mounting groove, with which said basic body can be caused to engage said coupling web of said clamping sleeve in a positive-locking manner.

5. A tool system in accordance with claim 1, wherein said tools each have a guide shaft for being pushed fittingly into a through hole of said centering sleeve and can be aligned coaxially with a central longitudinal axis of the mounting hole.

6. A tool system in accordance with claim 5, wherein each of said tools is provided on a respective guide shaft with a radially projecting stop web or with a stop collar, by which the axial depth of pushing into the centering sleeve is limited in a defined manner.

7. A tool system in accordance with claim 5, wherein at least one of said tools comprises a core hole drill, by means of which a mounting tube of the glow plug can be drilled out in the area of a mounting thread.

8. A tool system in accordance with claim 5, wherein at least one of said tools comprises a screw tap, by means of which the internal thread provided for mounting the glow plug in the mounting hole can be retapped.

9. A tool system in accordance with claim 5, wherein at least one of said tools comprises a reamer, by means of which the mounting hole can be finished after removal of the glow plug.

10. A tool system in accordance with claim 9, wherein said reamer has a stepped diameter, wherein a mounting hole of a stepped design can be finished with said reamer and can be restored to a new state.

11. A tool system in accordance with claim 5, wherein at least one of said tools comprises a core hole drill for drilling out the mounting hole in the area of the internal thread provided for mounting the glow plug to a larger core diameter.

12. A tool system in accordance with claim 11, wherein at least one of said tools comprises a screw tap tool for tapping an internal thread with a larger nominal diameter in a drilled-out section of the minting hole prepared by said core hole drill.

* * * * *